United States Patent [19]

Alexander et al.

[11] 3,981,476

[45] Sept. 21, 1976

[54] SPREADER CLIP ASSEMBLY FOR A CONCRETE WALL FORM

[75] Inventors: Kenneth B. Alexander; Robert J. Flathau, both of Elgin, Ill.

[73] Assignee: Symons Corporation, Des Plaines, Ill.

[22] Filed: Feb. 6, 1975

[21] Appl. No.: 547,759

[52] U.S. Cl. ..... 249/42; 249/217

[51] Int. Cl.[2] ..... E04G 17/08

[58] Field of Search ..... 249/40–46, 249/190–191, 213–214, 216–217, 219 R, 219 W

[56] References Cited

UNITED STATES PATENTS

| | | | |
|---|---|---|---|
| 2,074,460 | 3/1937 | Colt | 249/213 |
| 2,823,441 | 2/1958 | Williams | 249/190 |
| 2,962,789 | 12/1960 | Williams | 249/190 |
| 3,169,294 | 2/1965 | Bonin et al. | 249/196 |
| 3,204,918 | 9/1965 | Bonin et al. | 249/196 |
| 3,357,672 | 12/1967 | Capek | 249/45 |
| 3,679,168 | 7/1972 | Weaver et al. | 249/166 |

OTHER PUBLICATIONS

Symons Corp. Catalog No. AV-2, "Versiform System," 1973.

Symons Corp. Catalog 73-73, "Vertical Forming Systems," 1973.

*Primary Examiner*—Francis S. Husar
*Assistant Examiner*—John McQuade
*Attorney, Agent, or Firm*—Norman H. Gerlach

[57] ABSTRACT

A spreader clip assembly which is designed for use in connection with a concrete wall form and cooperates with a she-bolt on one end of a tie rod in preventing inward collapse of the adjacent side of a concrete wall form prior to pouring of wet concrete between the opposed form sides. A washer which is loosely and telescopically received over the she-bolt bears against the outer side of the adjacent form side and is clamped thereto by a nut, while an inverted J-shaped spreader clip proper which is captured on the washer is movable by a compound angular swinging and sliding action between a locking position wherein it straddles both the nut and washer and assimilates any tendency for inward collapse of the adjacent form side, and an out-of-the-way position wherein it exposes the nut for manipulating purposes.

7 Claims, 5 Drawing Figures

SPREADER CLIP ASSEMBLY FOR A CONCRETE WALL FORM

The present invention relates generally to a concrete wall form and has particular reference to that type of concrete form which consists of opposed, vertically extending, spaced apart form sides, each of which embodies a series of rectangular plywood or other panels arranged in edge-to-edge relationship and reinforced by horizontal walers, or vertical strongbacks or both, such walers or strongbacks bridging the entire width or height of the form sides on the outer sides of the latter, with opposed walers or strongbacks on opposite sides of the form being connected together by horizontally extending tie rods which have she-bolts at their outer ends and serve to assimilate the outward reaction thrust of the wet concrete which is poured between the form sides in connection with the formation of a concrete wall.

Heretofore, it has been customary to employ vertical strongbacks which consist of pairs of structural metallic channel members which are slightly spaced apart and between which the she-bolts project, cast metal washers being loosely received over the outer ends of the she-bolts and held in position by fastening nuts which are threadedly received on the she-bolts, the washers bridging the distance between the pairs of channel members of the strongbacks, bearing against the outer sides of the channel members, and the nuts, when properly and accurately received on the she-bolts, absorbing the reaction thrust of the poured concrete and serving to maintain the form sides in their proper vertical positions. However, prior to pouring of the concrete between the forms, it is necessary to afford suitable means for preventing inward displacement or collapse of the form sides due to the fact that the fastening nuts are capable only of assimilating an outward thrust on such form sides but are incapable of preventing inward shifting movement of the form sides.

One relatively simple means for thus holding the form sides erect and against inward displacement or collapse consists in the use of metal members of U-shape configuration (commonly referred to as spreader clips), such members being of rigid one-piece construction and having flat parallel side flanges or legs and flat connecting webs or bight portions. After the form sides have been assembled and erected in their spaced apart relationship with the she-bolts projecting through and between the adjacent pairs of channel members of the vertical strongbacks and with the washers and their associated fastening nuts applied, one of these spreader clips is caused by a manual operation to be applied to each washer and nut by the simple expedient of placing the same in straddling relationship over the washer and nut with the inside face of one leg opposing the nut and the other leg opposing the inside face of the washer. The washer is bolted to the adjacent strongback and thus the spreader clip maintains the associated washer and nut in close proximity to each other so that if there is a tendency for the adjacent form side to collapse inwardly, the washer which holds the associated strongback anchored thereto is unable to move away from the nut to any appreciable extent and, hence, said adjacent form side is maintained substantially erect and vertical pending concrete-pouring operations which then force the form side outwardly against the reaction thrust of the nut. After the concrete has hardened and it is desired to dismantle the form, the spreader clips may be manually pulled from their locking position so that access may be had to the nuts for loosening purposes, the clips being separate and unitary structures. Examples of such spreader clips are disclosed on page 4 of Catalog No. AV-2 of Symons Corporation of Des Plaines, Illinois, published in 1973, and entitled "VERSIFORM SYSTEM," and also on page 19 of said Symons Corporation's 73–73 catalog published in 1973, and entitled "VERTICAL FORMING SYSTEMS."

Spreader clips of the character set forth above are possessed of certain limitations, principal among which is the fact that they are loose items which easily become misplaced so that a workman, during erection of a given concrete wall form, is obliged to carry with him a supply of such clips. Also, at the time of concrete form dismantling operations, the workman must keep track of or provide a special place for such clips. Furthermore, during actual clip application to the associated nut and washer assembly, care must be taken in order to effect the application in a proper manner, each clip being fitted in place, so to speak, by the operator. The present invention obviates these difficulties by providing a captured clip which is intimately associated with the associated washer and which, after the washer has been operatively clamped in position on the adjacent strongback, walers or other panel-supporting members, is capable of being shifted bodily and thereafter swung to an out-of-the-way position where it does not interfere with application of the associated fastening nut to the threaded she-bolt and then, after the nut has been applied and tightened to the desired degree, may be flipped by a simple manual operation to its operative position wherein it straddles the washer and nut and binds the washer to the nut so that the former may not travel inwards of the adjacent wall form side, carrying with it the associated strongback and, consequently, the entire adjacent form side and the latter is thus held substantially vertically erect until after concrete-pouring operations have been completed.

The provision of a spreader clip assembly such as has briefly been outlined above, and possessing the stated advantages, constitutes the principal object of the present invention.

Other objects and advantages of the invention, not at this time enumerated, will become readily apparent as the nature of the invention is better understood from a consideration of the following detailed description.

The invention consists in the several novel features which are hereinafter set forth and are more particularly defined by the claims at the conclusion hereof.

In the accompanying two sheets of drawings forming a part of this specification, one illustrative embodiment of the invention is disclosed.

Figure 1:
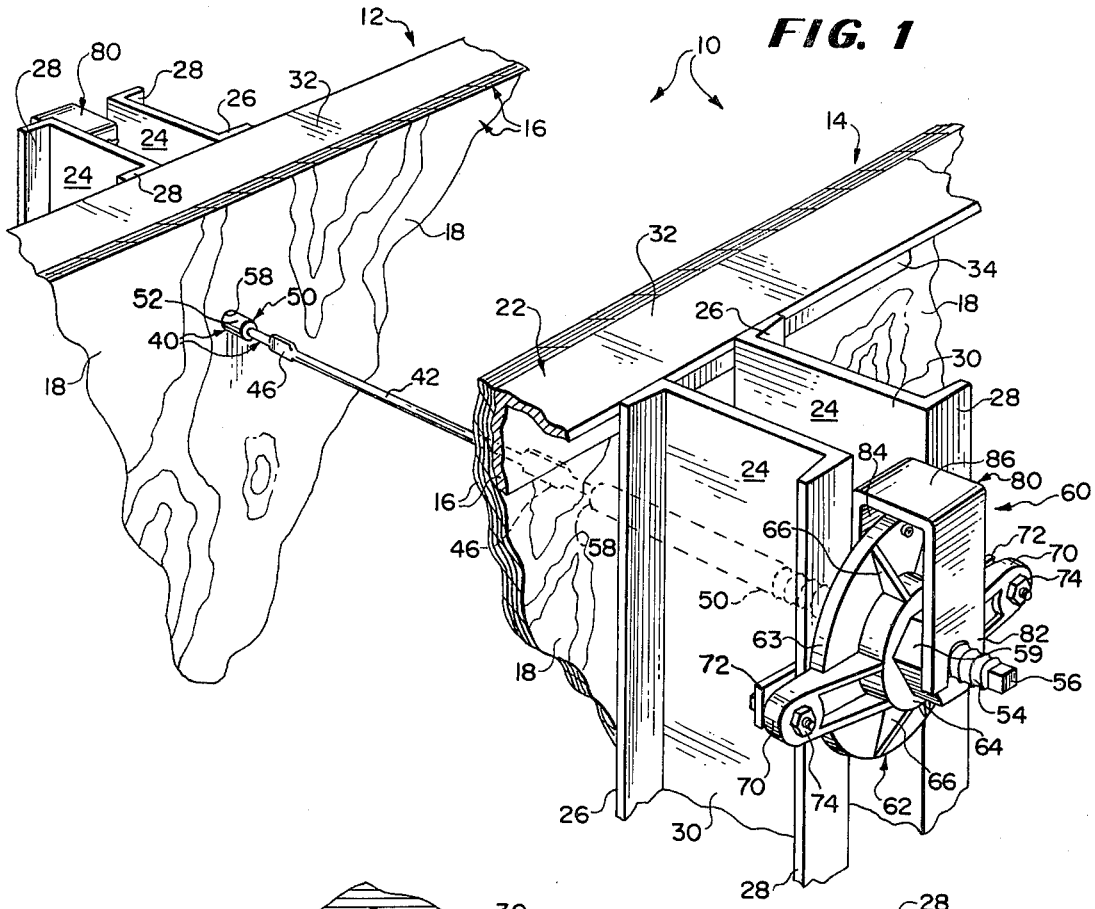
FIG. 1 is a fragmentary perspective view, partly in section, of a concrete wall form showing the improved spreader clip assembly of the present invention operatively applied thereto.

Referring now to the drawings in detail and in particular to FIG. 1, a fragmentary portion of a composite concrete wall form of conventional construction is illustrated therein and designated in its entirety by the reference numeral 10. The wall form is made up of two opposed, vertically extending, spaced apart sides 12 and 14, each of which consists of a series of rectangular panel units 16. It will be understood that although only one panel unit 16 on each side of the wall form is disclosed herein, each of the two form sides 12 and 14 is made up of a plurality of such units with the adjacent units of each series being arranged in edge-to-edge relationship.

The panel units 16 may be of any conventional construction, the particular units selected for illustration herein consisting of rectangular plywood facings 18 which are bounded and reinforced by rectangular marginal steel frames, the latter including horizontal top and bottom frame members and vertical side frame members, only the top frame members 22 of each panel unit 16 being disclosed in the accompanying drawings. If desired, other forms of panel units, such as "Steel-Ply" panel units of the type which is manufactured and sold by Symons Corporation of Des Plaines, Illinois, may be employed. Alternatively, all wood panel units are capable of being used. Irrespective, however, of the particular type of panel units which are employed, the essential features of the present spreader clip assembly remain substantially the same.

As is customary with a wide variety of concrete wall forms having opposed series of panel units such as the units 16, vertical strongbacks 24 are employed for reinforcing and aligning the panel units 16 of each of the form sides 12 and 14, such strongbacks being each in the form of a pair of slightly spaced apart, shallow, vertically elongated channel members having inner and outer outwardly extending short parallel side flanges 26 and 28 and interconnecting web portions 30.

In the illustrated form of panel unit, the top frame member 22 is in the form of an anglepiece having a horizontal, outwardly extending flange 32 and a vertical, downwardly extending flange 34, and it will be understood that the horizontal bottom and vertical side frame members will be of similar anglepiece construction. Insofar as the vertical strongbacks 24 are concerned, the inner side flanges 26 of the channel members thereof bear inwardly against and are suitably secured to the horizontal flanges 32 of the top frame members 22.

Conventional horizontally extending tie rod and she-bolt assemblies 40 are employed for maintaining the panel units 16 of the two form sides 12 and 14 of the concrete wall form 10 in their spaced apart relationship, these assemblies being in the form of medial or intermediate tie rods 42 and associated outer she-bolts 50. The tie rod 42 of each assembly 40 is provided with the usual reaction flats 46, while the opposite ends thereof embody external screw threads 48 (see FIG. 2). Each she-bolt consists of an inner cylindrical section 52 with an internally-threaded socket at its inner end and, in addition, an outer, externally-threaded section 54, the latter having a squared wrench-receiving outer end 56 by means of which torque may be applied to the she-bolt for tightening purposes in the usual manner of tie rod tensioning. The internally-threaded sockets at the inner ends of the she-bolts 50 are in screw-threaded engagement with the external screw threads 48 on the opposite ends of the tie rod 42. Each she-bolt 50 extends between the channel members of the associated pair of strongbacks 24 and passes through a small opening or hole 58 (see FIG. 1) which is formed in the plywood facing 18 of the adjacent panel unit 16. A clamping nut 59 is received over the outer end region of the outer threaded section 54 of each she-bolt 50 and cooperates with the spreader bar assembly of the present invention for tie rod tensioning purposes.

The arrangement of parts thus far described is purely conventional and no claim is made herein to any novelty associated with the same, the novelty of the present invention residing rather in the nature and construction of a novel spreader clip assembly 60 which not only is characterized by the fact that the spreader clip proper thereof due to its shape and particular manner of attachment to the associated casting (washer) permits the storage thereof in a gravity stable condition when not in use, but also prevents inward collapse of the adjacent form side during installation of the concrete form 10 before the tie rod of the said assembly 40 is tensioned and the wet concrete poured between the form sides 12 and 14. Whereas only one tie rod and she-bolt assembly 40 with its associated spreader clip assembly is illustrated in the drawings, it will be understood that a plurality of other such assemblies will be used in connection with the form.

Figure 2:
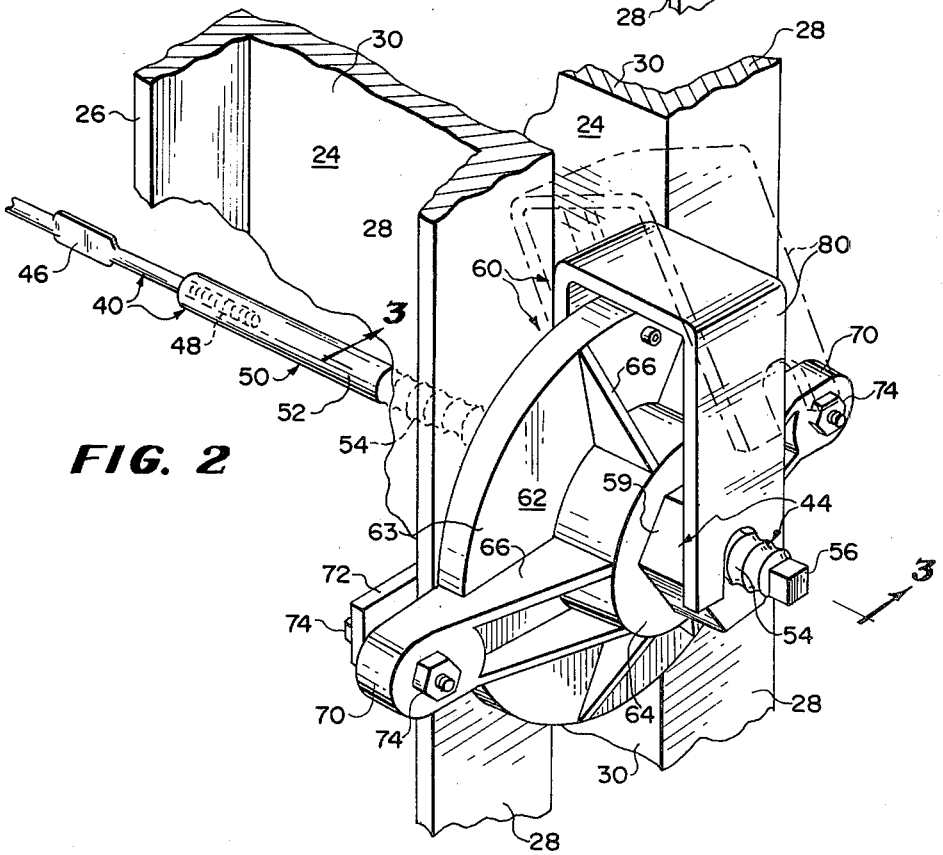
FIG. 2 is an enlarged fragmentary perspective view of the spreader clip assembly, showing the same in its operative position with respect to an associated she-bolt and also illustrating in dotted lines its position of release.
Figure 3:
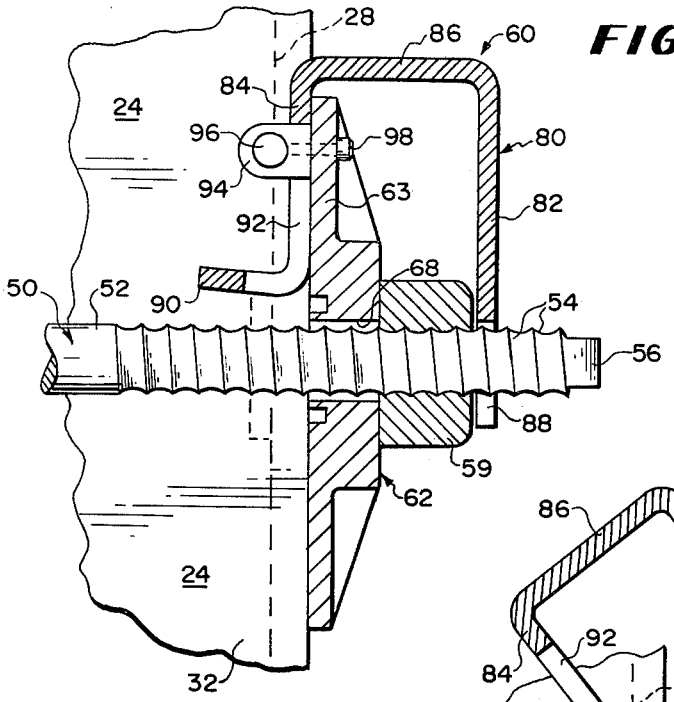
FIG. 3 is a sectional view taken substantially on the vertical plane indicated by the line 3—3 of FIG. 2 and in the direction of the arrows.
Figure 4:
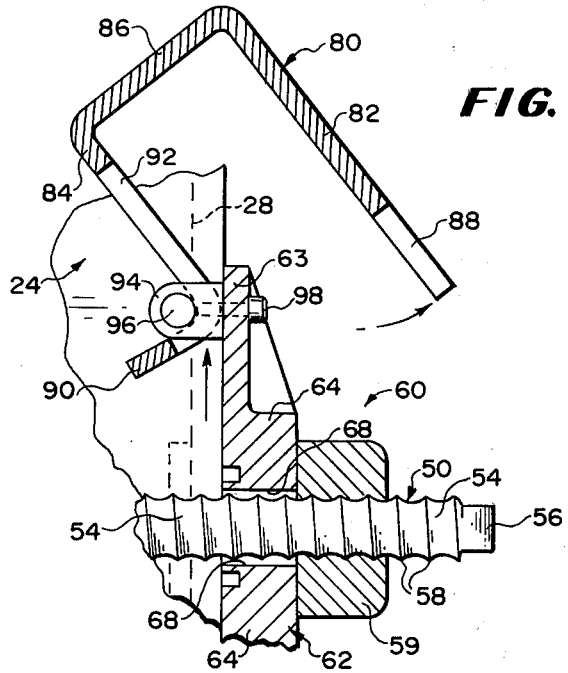
FIG. 4 is a sectional view similar to FIG. 3, but showing the spreader clip assembly in its position of release.
Figure 5:
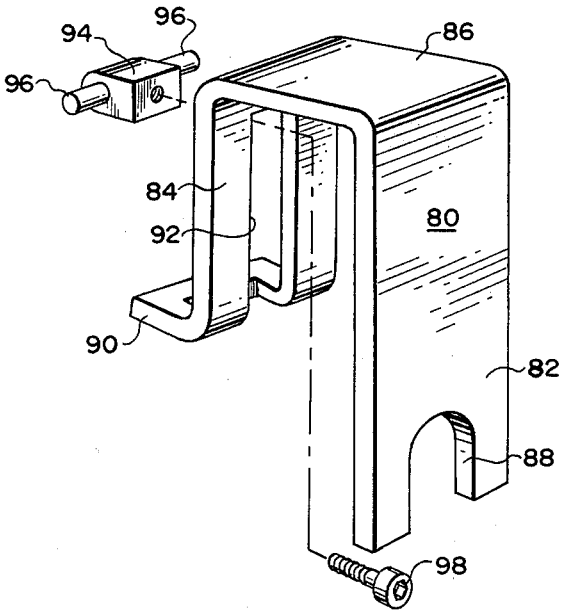
FIG. 5 is an enlarged exploded perspective view of the constituent parts of the spreader clip assembly of the present invention.

Still referring to FIGS. 1 and 2, and additionally to FIGS. 3, 4 and 5, the improved spreader clip assembly 60 involves in its general organization a generally circular reaction washer 62 which is preferably in the form of a metal casting and embodies a relatively flat circular body portion 63 from which there projects outwardly a cylindrical hub 64. Triangular gusset-like webs 66 extend between the hub 64 and the outer side face of the body portion and serve to reinforce the washer 62 as a whole. The hub and the body portion are formed with a central bore 68 (see FIGS. 2 and 3) through which the outer threaded section 54 of the adjacent she-bolt extends. The washer 62 spans the distance between the two vertical channel members of the associated strongback 24 and bears inwardly against the two outer flanges 28 of said members as clearly shown in FIGS. 1 and 2 of the drawings under the tightening force of the nut 59.

The washer 60 is provided with a pair of diametrically opposite, radially extending clamping ears 70 which overhang the outer side edges of the flanges 28 of the channel members of the adjacent strongback 24 and cooperate with rectangular clamping plates 72 and nut and bolt assemblies 74 in fixedly securing the washer 62 in position on the said strongback 24.

It will be noted from an inspection of FIGS. 3 and 4 of the drawings that the outer threaded section 54 of the she-bolt 50 passes loosely through the washer 62 so that during initial erection of the concrete wall form 10 and prior to pouring of the wet concrete between the two form sides 12 and 14, there ordinarily will be no reaction force which would prevent inward displacement or collapse of these form sides. According to the present invention and in order to afford such a reaction force, a generally inverted J-shaped, retainer-type, spreader clip proper 80 is both pivotally and slidingly mounted on the washer 62 in such a manner that it may be caused to assume the out-of-the-way position wherein it is shown in full lines in FIG. 4 of the drawings and in dotted lines in FIG. 2 in order to allow the nut 59 to be applied to the outer extremity of the outer threaded section of the she-bolt 50 during initial erection of the concrete wall form 10, and the locking position wherein it is shown in full lines in FIGS. 1, 2 and 3 so that it assimilates any tendency for inward displacement or collapse of the form sides 12 and 14 prior to concrete pouring operations, all in a manner that will be set forth in detail presently.

Accordingly, the clip member 80, the details of which are clearly shown in FIG. 5, is provided with a relatively long outer leg 82, an inner and somewhat shorter leg 84, and a flat connecting bight portion 86 at and between the upper ends of the outer and inner legs. A notch 88 is formed in the lower or distal end of the outer leg 82 while the lower end of the inner leg 84 is provided with a laterally turned or right angle flange-like portion 90. The inner leg 84 and a portion of the flange-like portion 90 of the clip member 80 has formed therein a longitudinally extending slot 92. An elongated small guide block 94 having outwardly extending trunnion-like pins 96 on opposite sides thereof is secured by a fastening screw 98 to the upper peripheral region of the inner side face of the body portion 63 of the washer 62. The side edges of the slot 92 straddle the block 94 and the trunnion-like pins 96 overhang the inner side surface of the leg 84 and serve to maintain the clip member 80 captured on the washer 62 as best shown in FIG. 4.

The locking position of the clip member 80 is shown in FIG. 3 wherein it will be observed that the block 94 assumes a position at the extreme upper end of the slot 92 while at the same time the notch 88 straddles the outer end region of the outer threaded section 54 of the she-bolt 50 and lies close to the front face of the nut 59 as best shown in FIG. 3. In the unlocked position of release as shown in FIG. 4, the clip member 80 is swung upwardly to an inclined position wherein the notch 88 is withdrawn from the outer threaded section of the she-bolt 50 while the block 94 passes through the slot 92 at the juncture region between the flange-like portion 90 and the inner leg 84, such position of the clip member 80 being a stable one inasmuch as the major portion of the weight of the clip member lies on the inner side of the washer 62 with the weight of the clip member 80 being borne largely by the trunnion-like pins 96 on the ends of the block 94.

In the operation of the herein described spreader clip assembly, wall form erection is made in the usual manner by first setting up the two form sides 12 and 14, then applying the strongbacks 24 thereto in their vertical positions as shown in FIGS. 1 and 2 or, alternatively, utilizing waler boards in their horizontal positions, and then causing the tie rods 42 and their associated she-bolts 50 to bridge the form so that the she-bolts pass through the holes 58 in the plywood facings of the panel units 16 and pass between the strongbacks 24, after which the circular washers 62 are slipped over the outer regions of the threaded sections of the she-bolts 50 so that they bear against the outer flanges 28 of the channel members of the strongbacks 24. At this time, the inverted J-shaped clip members 80 are swung to their out-of-the-way position as indicated in FIG. 4 in order to afford clearance so that the nuts 59 may be threadedly received on the outer regions of the outer threaded sections of the she-bolts 50 and then tightened to the degree necessary to adjust the form sides 12 and 14 to their true vertical positions, after which the clip members 80 are swung outwardly and slid downwardly to the position indicated in FIG. 2 to the end that the outer faces of the nuts 59 afford reaction surfaces against the outer legs 82 of the clip members and thus prevent inward displacement or collapse of the form sides. The wet concrete may then be poured between the form sides 12 and 14 and the spreading action of such concrete against the form sides will relieve the flexion in the clip members 80 which formerly prevented inward collapse of the form sides. From the above description, it will be apparent that the sole function of the herein described spreader clip assembly is to hold the form sides 12 and 14 erect during the brief interval of time that is consumed after form erection is completed and before the time that the concrete is poured into the space between the form sides for wall-forming purposes. After concrete-pouring operations are completed, the spreader clip assembly remains in situ but has no function.

When it is desired to dismantle the form after the poured concrete has become set, it is a simple matter to swing the spreader clip 80 from its locked position of FIG. 3 to its unlocked position of FIG. 4, after which the nut 59 is completely accessible for removal purposes.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

Having thus described the invention what we claim as new and desire to secure by Letters Patent is:

1. In a concrete wall form of the type wherein opposed form sides, each consisting of panel units disposed in edge-to-edge relationship, are reinforced by outside, spaced apart, vertical strongbacks, wherein adjacent strongbacks on each form side are bridged and connected by reaction washers through which tie rod-connected she-bolts having externally threaded outer end regions loosely project, wherein fastening nuts are threadedly received on the outer threaded ends of the she-bolts so as to resist the outward spreading action of the washers incident to the outward thrust of wet concrete which is poured between the form sides, and wherein means are provided on said washers for releasably clamping said washers to their respective pairs of strongbacks, the improvement which comprises: a clip member of inverted J-shape configuration having a relatively short inner leg and a relatively long outer leg connected together at their upper ends by a bight portion associated with each she-bolt, and means captively and pivotally connecting said clip member at the inner leg thereof to the associated reaction washer for swinging movement of the clip member between a lowered vertical locking position wherein said legs straddle the adjacent nut and washer with the outer leg opposing the outer face of the nut, captively locating said nut between said washer and the inner face of the outer leg, and an out-of-the-way raised upwardly inclined position wherein a major portion of the clip member is disposed between and straddled by the adjacent strongbacks and the outer leg is withdrawn from the nut in order to render the latter accessible for wrench-receiving purposes.

2. That improvement in a concrete wall form as set forth in claim 1 and wherein the distal lower end region of said outer leg of the clip member has formed therein a clearance notch which straddles the outer end of the externally-threaded region of the associated she-bolt in close proximity to the outer face of said nut when the clip member is in its locking position.

3. That improvement in a concrete wall form as set forth in claim 2 and wherein the inner leg of the clip member has formed therein an elongated vertical slot through which extends loosely a guide member which projects inwardly from the peripheral region of the washer and by means of which such leg is slidingly and pivotally connected to the washer.

4. That improvement in a concrete wall form as set forth in claim 3 and wherein the guide member is in the form of a small block which projects through the slot, and trunnion-like pins are provided on the block for capturing the inner leg of the member in position on the washer.

5. That improvement in a concrete wall form as set forth in claim 4 and wherein the distal end of the inner leg is turned laterally outwardly to provide a limit stop for the upward sliding movement of the clip member.

6. That improvement in a concrete wall form as set forth in claim 5 and wherein the slot in the inner leg of the clip member projects a slight distance into said laterally-turned distal end of such leg.

7. That improvement in a concrete wall form as set forth in claim 6 and wherein said block is fastened to the peripheral region of the washer by means of a fastening screw.

* * * * *